US005624017A

United States Patent [19]

Plesko

[11] Patent Number: 5,624,017

[45] Date of Patent: Apr. 29, 1997

[54] MULTI-PURPOSE CURRENCY VALIDATOR WITH COMPACT LOW POWER CASSETTE STACKER

[75] Inventor: George A. Plesko, Media, Pa.

[73] Assignee: GAP Technologies, Inc., Media, Pa.

[21] Appl. No.: 224,013

[22] Filed: Apr. 6, 1994

[51] Int. Cl.[6] ..... G07D 7/00

[52] U.S. Cl. ..... 194/207; 271/178; 382/137

[58] Field of Search ..... 194/206, 207; 209/534; 271/178, 181; 250/556; 382/7

[56] References Cited

U.S. PATENT DOCUMENTS

| | | | |
|---|---|---|---|
| 3,223,988 | 12/1965 | Danko | 209/534 X |
| 3,245,534 | 4/1966 | Smith et al. | 194/206 X |
| 4,380,734 | 4/1983 | Allerton | 382/7 X |
| 4,678,072 | 7/1987 | Kobayashi et al. | 194/206 |
| 4,749,076 | 6/1988 | Akagawa et al. | 194/207 |
| 4,807,736 | 2/1989 | Kondo et al. | 194/206 |
| 4,854,247 | 8/1989 | Sciortino et al. | 194/206 X |
| 4,880,096 | 11/1989 | Kobayashi et al. | 194/206 |
| 5,308,992 | 5/1994 | Crane et al. | 250/556 |
| 5,333,714 | 8/1994 | Watabe et al. | 271/181 X |

FOREIGN PATENT DOCUMENTS

| | | | |
|---|---|---|---|
| 3-288762 | 12/1991 | Japan | 271/178 |

*Primary Examiner*—F. J. Bartuska
*Attorney, Agent, or Firm*—Reed Smith Shaw & McClay

[57] ABSTRACT

A modular bill validator is disclosed consisting of easily separable modules and sub-modules. The main modules consist of a validation module and a removable, lockable or sealable stacker module. The validation module has slide out sub-modules can function independently without a stacker module or can accept replaceable stacker modules of different styles and sizes. The stacker module comprises a novel low power mechanism with moveable stacker bars to effect stacking of bills rather than fixed rails and a pusher plate thereby achieving an appreciable saving of space over prior art devices and permitting greater stacking capacity for bills. Various security options as well as improved sensing and validation techniques are also disclosed.

1 Claim, 8 Drawing Sheets

MULTI-PURPOSE CURRENCY VALIDATOR WITH COMPACT LOW POWER CASSETTE STACKER

BACKGROUND OF THE INVENTION

Paper currency validators, often referred to as "bill validators", have enjoyed commercial success in the vending industry for many years. As vending sales move toward higher average values the demand for improved devices increases. Numerous applications, still however, go unfulfilled. For example in the pay telephone industry where sufficient power is virtually unavailable in remote locations the presently available devices consume too much power to be used. Improvement is also needed in validation accuracy especially where high value bills are submitted. Automatic ticket vending, postage stamp vending and the gaming industry require the highest accuracy in validation because high denomination currency must be accepted in these transactions.

In typical bill validators currently available, paper currency is fed into a slot located at the front of the unit, the presence of the bill is detected and it is conveyed into the unit where its validity and denomination is determined. If the bill is acceptable it is then further conveyed into a stacker where it is stored in a compact stack and credit is issued for its value.

In vending equipment it is highly desirable to complete the transaction as quickly as possible and to stack the bills in as compact a stack as possible. The compact stack should be easy to remove and handle at the designated counting location and the stacker should hold as many bills as possible in the space allotted within the vending equipment.

Paper currency can be limp, damp, wrinkled, folded or torn and can create jams in equipment. During bill conveyance and especially stacking is when most jams occur. These can render an entire vending outlet inoperable until service personnel arrive to clear the jam. Thus simple positive acting mechanisms are needed.

Present bill stacker mechanisms are complex and most operate using variations of cam driven pusher plate mechanisms. In these a bill is conveyed by a set of rubber belts along two fixed rails whereupon the bill stops and a pusher plate is activated which forcefully pushes the bill well beyond the fixed rails into the stack then the plate retracts. The operation is perceptibly slow and noisy and does not instill confidence in customers.

U.S. Pat. No. 4,678,072 describes such a system. The system requires a powerful high torque gear head motor, two cams, numerous guide rollers on the fixed rails to reduce friction, four scissor jack arms, numerous pivot pins, gears, pulleys, shafts and several compression springs, a pusher plate and return springs. The use of a pusher plate and fixed rails is typical of conventional stackers available today, however these consume a great deal of premium space which could have been otherwise used to stack additional bills. The many moving parts constitute opportunities for equipment failure and the complexity of these devices makes them costly to repair.

The process of collecting money from existing devices also poses opportunities for improvement. Money collection personnel are required to remove large amounts of money over a period of time from the stackers in vending equipment. Unfortunately the industry is plagued by some dishonest money collectors who steal a few percent of currency from each machine they service. It would be advantageous if light-weight sealed, traceable stackers were available which could be removed entirely from currency validation equipment by the money collector and replaced with empty sealed stackers. If such were the case the seal would have to be broken to steal and the owner of such equipment would know it had been tampered with. However, present stacker devices, are much too heavy, bulky and complex to remove and reinstall in this manner.

The vending industry also requires different capacity stackers, some capable of storing 200, 400 or 1000 bills. Since the known stackers are built permanently onto the validation part of the mechanism this leads to many different models and significant equipment inventory problems for both manufacturers and users alike.

Yet another need of the vending industry is for validator stackers which can vertically stack bills such as is illustrated in U.S. Pat. No. 4,678,072 and also units which can horizontally stack bills, however, this also leads to increased numbers of models.

In other applications stackerless bill validators are desired and bills are allowed to collect in a bin and these are again separate models.

SUMMARY OF THE INVENTION

A complete paper currency validator is disclosed consisting of easily separable modules and sub-modules. The main modules consist of a validation module and a removable, lockable or sealable cassette stacker module. The validation module has slide out sub-modules and can function independently without a stacker module or can accept replaceable stacker modules of different styles and sizes. The stacker module is distinguished from prior art stackers by its novel low power rotating stacker bar mechanism to effect stacking of bills. An appreciable saving of space over prior art devices is thereby afforded permitting greater stacking capacity for bills.

By virtue of the simple drive mechanism of the stacker it is easily adapted for removeability making possible various security options. A novel light guide system as well as improved magnetic ink sensing and validation techniques are also incorporated.

DESCRIPTION OF A PREFERRED EMBODIMENT

While the following description may refer to a currency or bill validator and to the items being handled as bills, it should be understood that the invention is applicable to other items which, like currency, are generally planar and provided in a predetermined format which may be evaluated for authenticity and for which evaluation and accumulation in a stack may be desirable. Accordingly, as used herein, the term "bill" refers not only to paper currency but to other such items as well.

Figure 1:
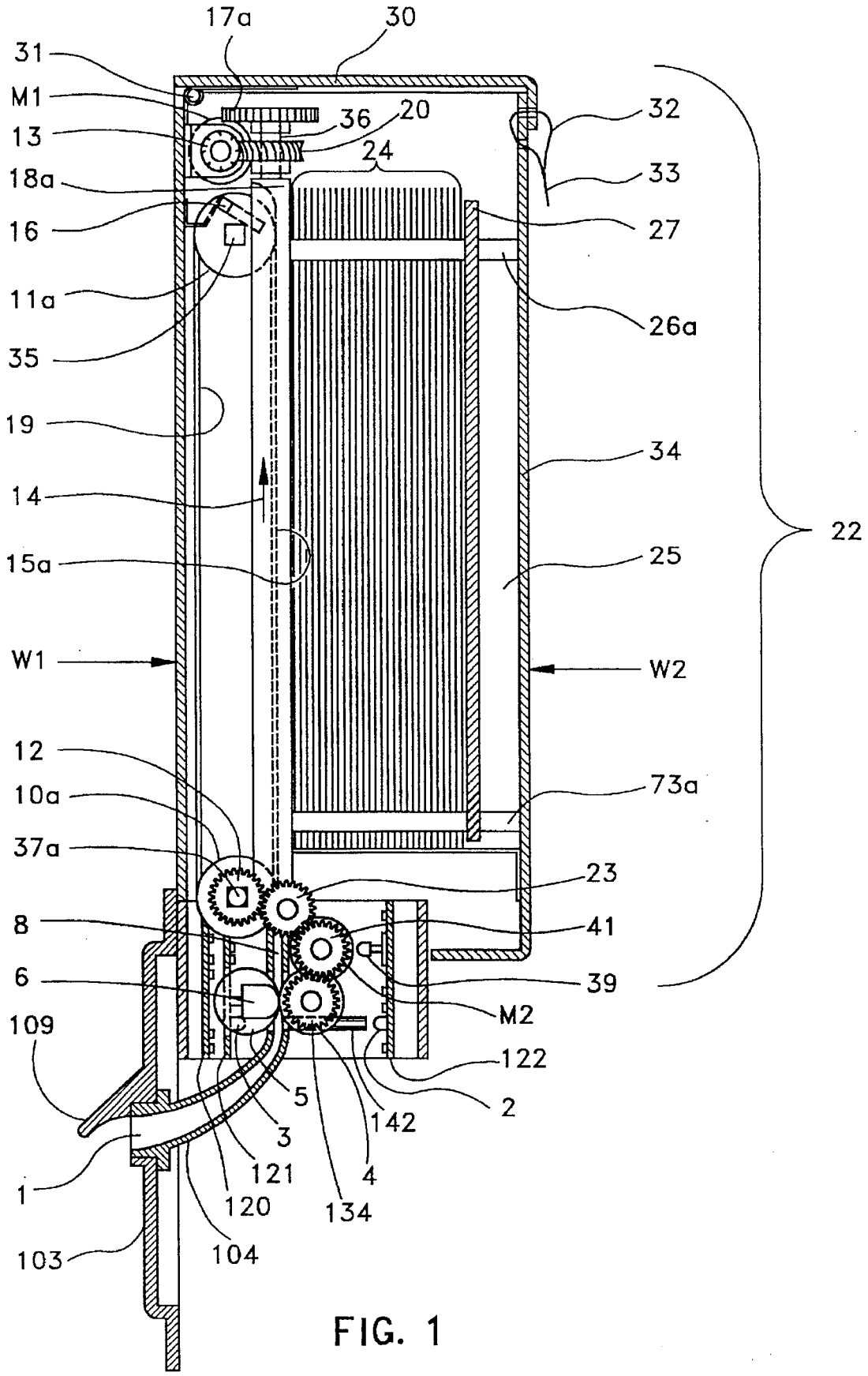
FIG. 1 shows an embodiment of the present invention with essential features of bill conveyance, sensing, and stacking mechanisms.

Shown in FIG. 1 is a cross sectional view of a currency validator emphasizing several key features of the present invention. The operation of the device begins when a candidate piece of paper currency is initially fed into bill insertion slot 1 whereupon reflective object light sensor 3 detects its presence. This initial detection activates the bill drive train consisting of opposing friction rollers 4 and 5 which pull the bill into the mechanism. The bill is conveyed along path 8 past validation sensor 6. In a best mode it is contemplated that validation sensor 6 is a low cost magnetic tape head adapted to sense the magnetic ink printed on the bill. This magnetic head may be either a single channel or multiple channel read head if more sensing detail is needed for added security. Optical reflective or transitive sensors may also be incorporated, or combinations of both magnetic and optical sensors may be used simultaneously to validate currency.

Electronic validation of the currency is accomplished as the bill progresses along path 8 to transition region 23 where it is engaged by a pair of stacker belts 9 and 19. For simplicity only belt 19 is shown in the view of FIG. 1. Belts 9 and 19 are, preferably rubber gear belts, and are spaced apart about the width of the bill and these convey the bill by friction up a corresponding pair of stacker bars 18*a* and 18*b* respectively.

Figure 7:
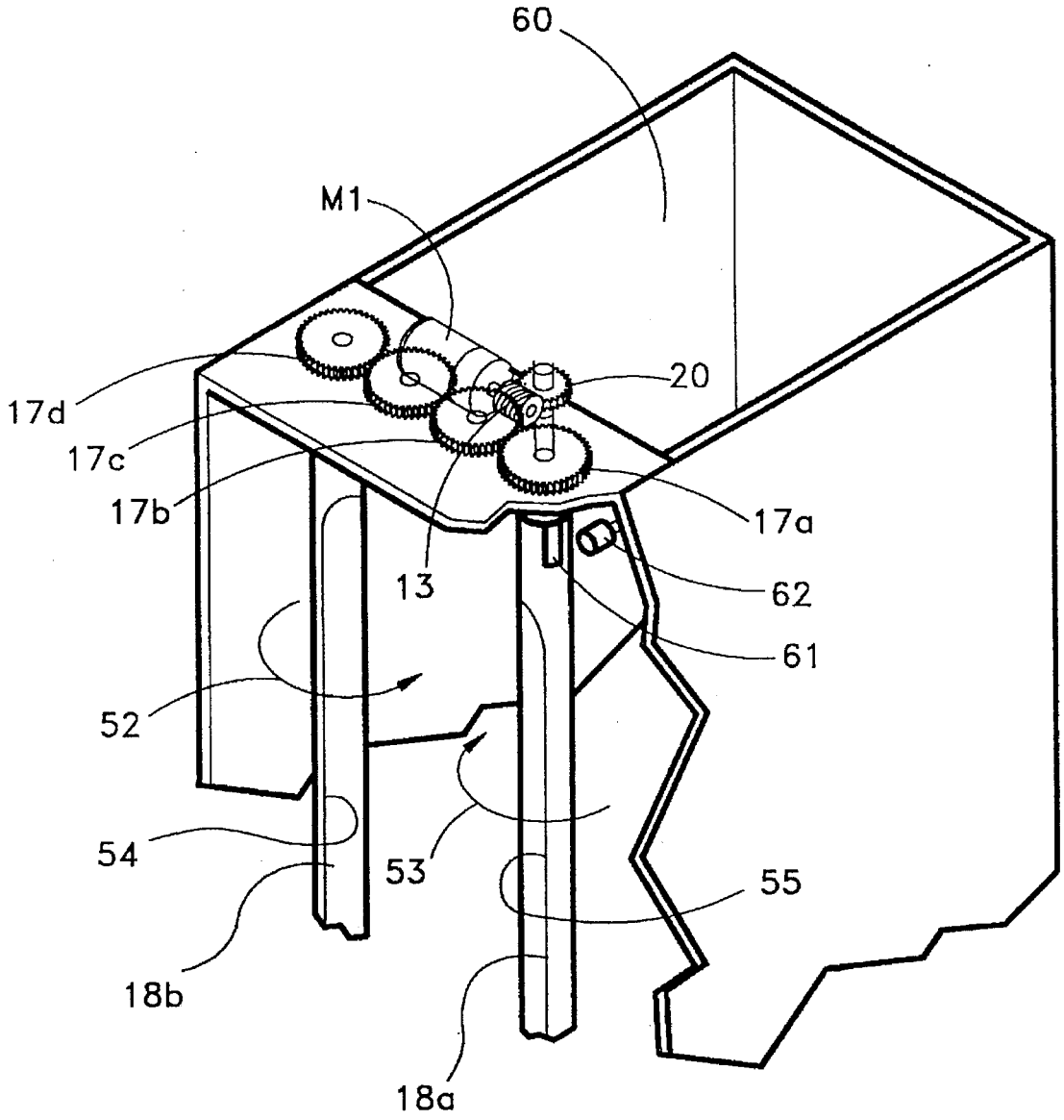
FIG. 7 shows details of how mechanical power is applied to make the stacker bars rotate.

Unlike any known prior art currency stackers, the accumulator device of the present invention employs non-fixed, moveable stacker bars. The moveable stacker bars by virtue of their motion cause a bill to be isolated into a stack and clear the conveyance path so that the next bill may be conveyed and stacked. In the best mode the moveable stacker bars accomplish their function by rotation. FIG. 7 illustrates rotatable stacker bars 18*a* and 18*b* which rotate in directions indicated by arrows 56 and 57. (For brevity the accumulator device will hereinafter be referred to as a "stacker".) The stacker bars have substantially flat surfaces 15*a* and 15*b* respectively included in a notched channel extending along their lengths and are made from material having a very low coefficient of sliding friction. During conveyance to the extreme ends of the stacker bars one surface of the candidate bill is gripped by the high friction conveyance belts which move the bill to the top of the stacker assembly by sliding the opposite surface of the bill easily along the flat surfaces 15*a* and 15*b* of the low friction rotatable stacker bars 18*a* and 18*b* as indicated in FIG. 2*c*. Stacker bars 18*a* and 18*b* are preferably made from a stiff, very low friction plastic such as a lubricated injection moldable plastic. The LNP Company of Exton, Pa. produces very excellent blends of such plastic. A preferred blend is known as RCL-4536 which consists of 6/6 nylon, 13% PTFE (Polytetrafluroethylene) resin used as a dry lubricant, 2% silicone lubricant, and 30% graphite fiber which imparts mechanical stability and ridgity to this material.

During its initial conveyance a bill is moved past sensors where validation occurs and a determination of the candidate bill's acceptability is made. If unacceptable, the conveyance sequence is reversed and the unacceptable bill is returned to the customer.

If however, the bill is found to be acceptable it is fully conveyed to the ends of the stacker bars where a sensor 16 of FIG. 1 detects the bill. Conveyance is then halted and the bill is now ready to be stacked.

To bring about stacking, motor M1 in FIG. 1 causes the stacker bars 18*a* and 18*b* to rotate 360 degrees. A small stepper motor is an ideal choice for this application since stepper motors are designed for controlled angular rotation.

Sufficient torque to turn the stacker bars at a reasonable speed may be obtained from motor M1 fitted with a worm 13 to drive worm gear 20 affixed to stacker bar 18*b*. These type gears afford very high reductions and thus high torque and suit the convenient right angle juxtaposition of gears shown in FIG. 1.

Once the bill is in position to be stacked the decision to place the bill irretrievably into the stack is made. Assuming that the bill is to be stacked, motor M1 is energized causing stacker bar 18*a* to rotate 360 degrees. Worm gear 20 may be conveniently molded as an integral part of stacker bar 18*a* in order to keep parts count to a minimum and assembly time low.

The detailed operation of the novel stacking mechanism may be clearly understood now by turning to FIGS. 2*a* through 2*e*. The conveyance portions of the rotatable stacker bars 18*a* and 8*b* have cross sections with angle shaped notches and flat low friction conveyance surfaces 15*a* and 15*b*, which are held in surface contact with stacker conveyance belts 9 and 19 respectively. A bill 50 is brought into position to be stacked by movement of the respective stacker belts causing it to slide along the low friction stacker bar surfaces 15*a* and 15*b*. The stacker bar surfaces 15*a* and 15*b* cooperate with the conveyance belts 9 and 19 to define a path along which a bill is conveyed, and to convey the bill along the path in a direction lying generally in the plane of the bill. As seen in FIG. 1 when bottom pulley 10*a* is driven causing belt 9 to move in the direction shown by arrow 14 and top pulley 11*a* is simply an idler pulley, then the portion of belt 9 in contact with bar 18*a* at surface 15*a* will be less taut than the opposite straight portion of the belt 9 which will be in relatively greater tension. This condition will guarantee that belts 19 and 9 are in good surface contact with their respective stacker bars to frictionally engage the bill for positive conveyance.

It is also contemplated that stacker bar surfaces 15*a* and 15*b* may be made with a slightly convex curvature toward their respective belts to further assure good belt contact for positive bill conveyance.

Figure 3:
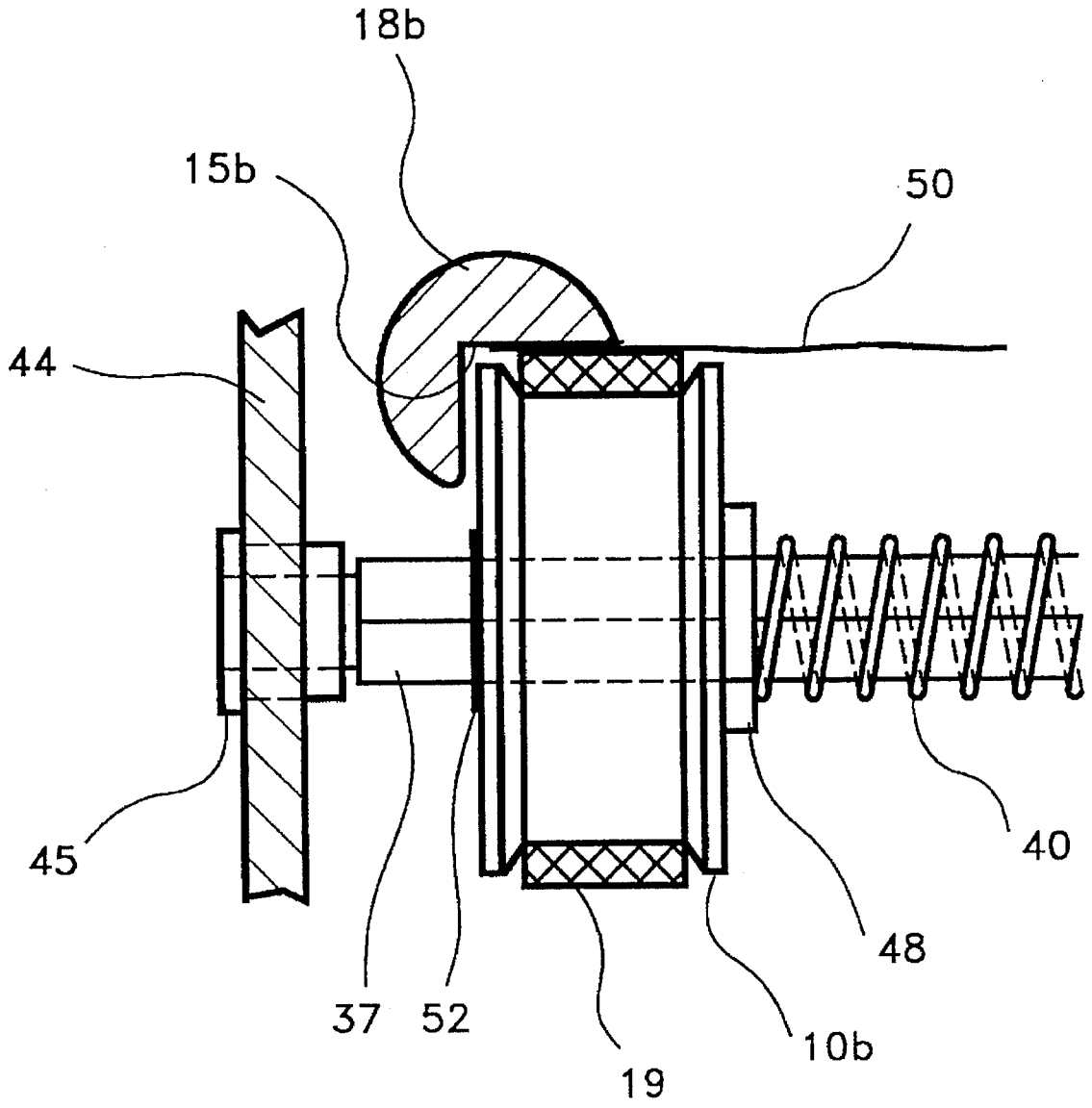
FIG. 3 shows in greater detail a portion of the stacker.

The two pair of pulleys are mounted on shafts 35 and 37 such that they are allowed limited sliding freedom. The two driven pulleys are mounted on splined shafts such as the square one numbered 37 in FIG. 3 while the non-driven pulleys are mounted so they can slide on their shafts also. Only the driven pair of pulleys need be mounted on splined shafts to allow transfer of rotational drive force. This mounting method for the pulleys allows them to move inward towards one another when the stacker bars rotate. The driven pair of pulleys are preferably the bottom ones 10*a* and 10*b* in this embodiment. Thus the bottom pulleys may be rotated by gears 12 and 23 shown in FIG. 1. This simple drive train enables the stacker to be easily removed from the validation portion of the bill validator. Thus the validation portion may provide mechanical power to operate a detachably securable stacker. The validation portion may also provide electrical operating power to operate a detachably securable stacker, such as to operate motor M1.

Figure 2A:
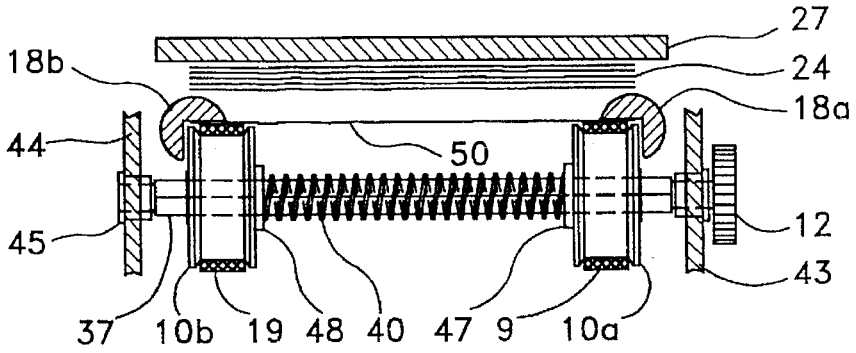
FIG. 2*a* shows the initial position of a bill to be stacked with the novel stacker of the present invention.
Figure 2B:
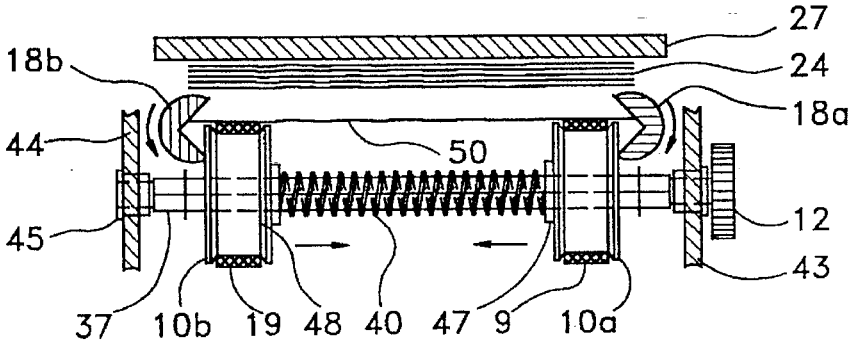
FIG. 2*b* shows how the stacker bars rotate and move the belt and pulley system out of the way.
Figure 2C:
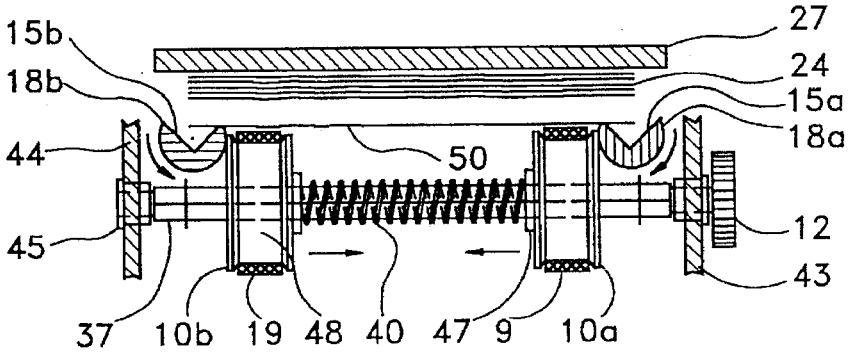
FIG. 2*c* shows how the bill is urged into the stack buy rotation of the stacker bars.
Figure 2D:
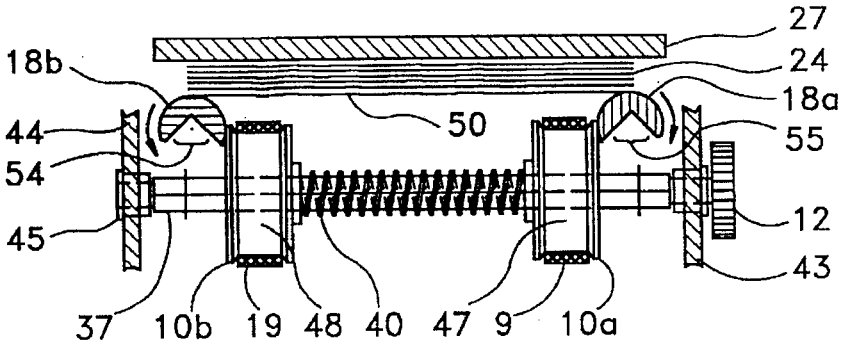
FIG. 2*d* shows the bill placed into the stack and the bars returning to their original position.

In order to stack a bill, its conveyance is stopped and the stacker bars are rotated 360 degrees in opposite directions as indicated by arrows 56 and 57 shown in FIG. 7, whereupon the edges of the bill are captured in the notched sections 54 and 55 of stacker bars 18*a* and 18*b* as shown in FIG. 2*d*.

Figure 2E:
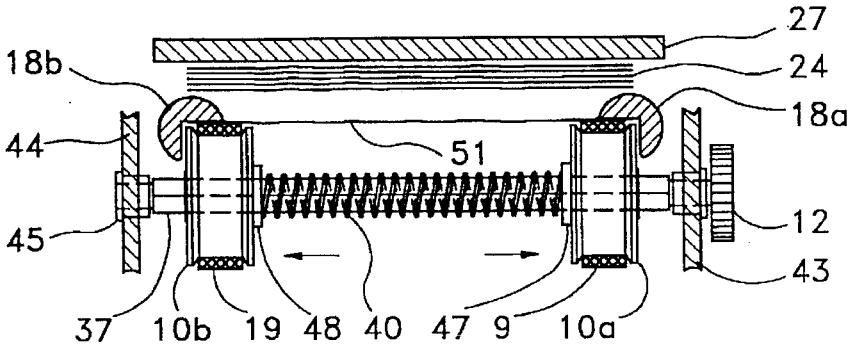
FIG. 2*e* shows the next bill ready to be stacked.

FIGS. 2*a* through 2*e* illustrate how the rotational sequence of the bars places the bill into the stack. During rotation of the bars, angled notches 54 and 55, shown in FIG. 2*d*, engage the edges of the bill and by inward rotation of the stacker bars indicated by curved arrows urge it into the stack 24. At the same time the rotation of the bars push the conveyance pulleys out of the way and toward one another as seen in FIG. 2*b*. Continued rotation of the bars through a full 360 degrees brings them back into position ready for the next stacking sequence as seen in FIG. 2*e*. A small magnet 61 embedded into stacker bar 18*a* is sensed by hall sensor 62 to ascertain and to verify that stacker bar 18*a* has completed its rotation and is ready for a new conveyance/stacking sequence.

During the stacking sequence the pulleys and belts must temporarily move out of the way while the bars rotate. This is accomplished by means of the mechanism further detailed in FIG. 2*b*. During rotation, the angular notched features 54 and 55 of FIG. 2*d* in the bars push the flanges of the pulleys inwardly toward one another carrying their respective belts with them. Upon completing their rotation, a spring such as spring 40 located on each pulley shaft returns the pulleys to their original positions after the bill is stacked.

FIG. 7 illustrates how the stacker bar drive mechanism rotates both bars simultaneously and in opposite directions. A gear train consisting of gears 17*a*,17*b*,17*c*, and 17*d* is shown at the top of the stacker. When stacker bar 18*a* rotates so does gear 17*a* attached to the top of it which in turn rotates the idler gears 17*b* and 17*c* rotate gear 17*d* attached to bar 18*b*. The gear train consists of an even number of gears so that bars 18*a* and 18*b* rotate in the opposite sense. Also gear 17*a* and 17*d* are the same size to guarantee an equal amount of rotation of both gears and their respective stacker bars.

Intermediate gears 17*b* and 17*c* are idler gears and need not be the same size as the stacker bar gears 17*a* and 17*d*. If desired the intermediate gears may be replaced with 4 smaller gears located towards the front of the stacker in order to allow more space for easy removal of bills.

In prior art devices a compressible spring is included behind a bill backup plate and a pusher plate is used to push a bill past fixed non-rotatable stacker bars. Thus as the stacker becomes full, the pusher plate is required to exert ever increasing pushing force with each additional bill stacked due to the increasing force of the compressible spring. This requires greater motor torque and more power to be expended with each bill stacked.

As will now be explained, the present invention, because of its novel rotating type stacker bar mechanism, does not need a compression spring behind the bill stack and therefore can operate with very low power.

Figure 4:
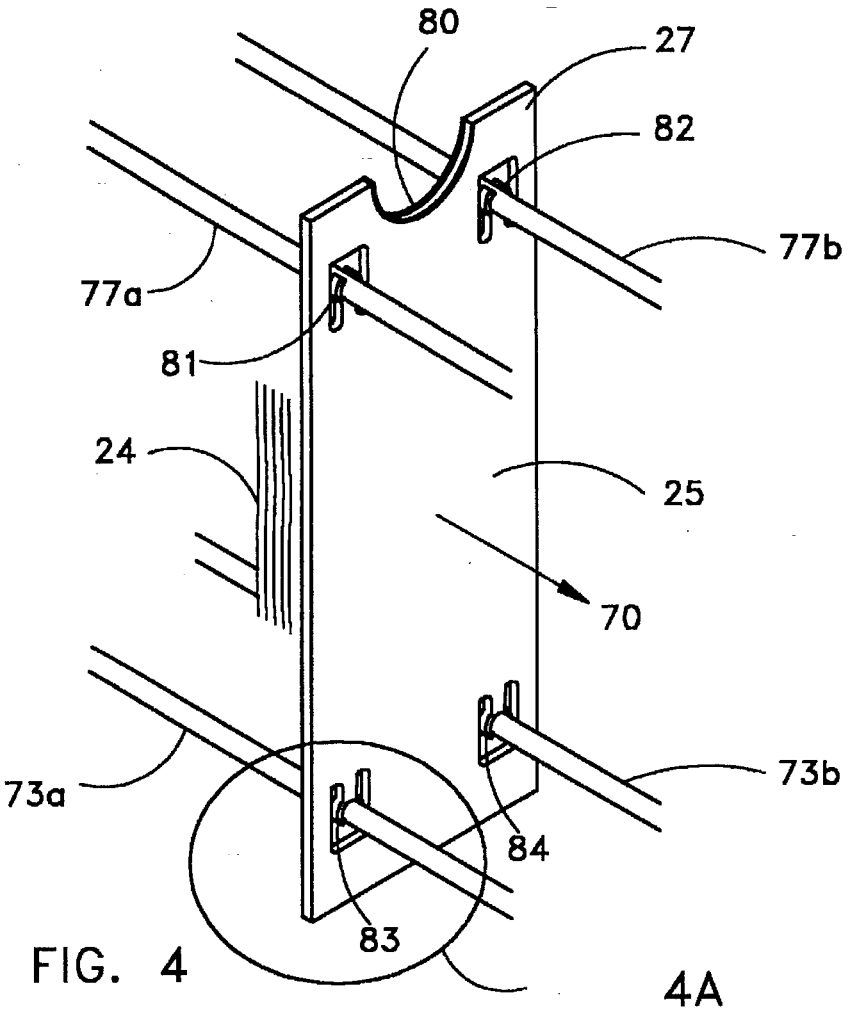
FIGS. 4 and 4*a* shows details of the bill back plate construction.
Figure 4A:
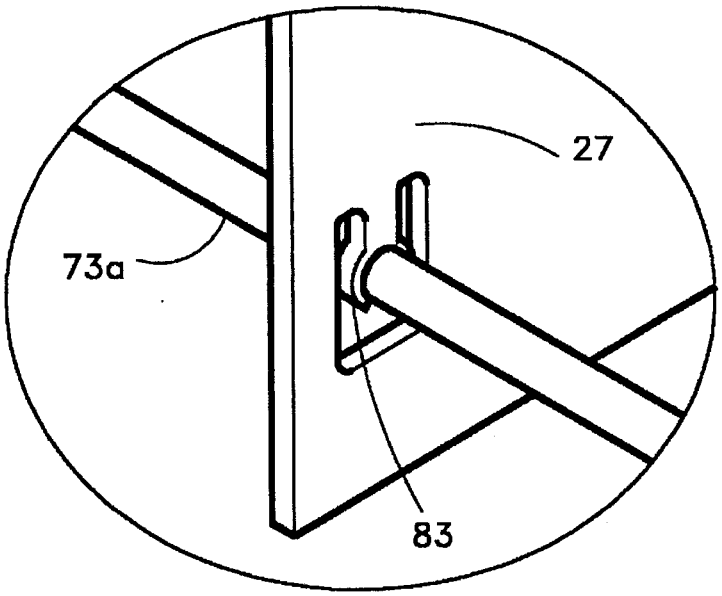

FIGS. 4 and 4A illustrates a novel constant force bill backer plate for use with the stacker mechanism of the present invention. The bill backer plate holds an accumulating stack of bills in place. Bill backer plate 27 has graspers 81,82,83 and 84 in its corner areas to provide sliding friction for backer plate 27 along guides 77*a*,77*b*,73*a*,73*b*. As bills accumulate in area 24, plate 27 slides back against the frictional force of the graspers in the direction of arrow 70 to accommodate the increasing volume of the bill stack. The backer plate 27 only moves back an incremental distance for each bill stacked against the frictional force applied by the four graspers. Since the distance moved is small for each bill and the drag force is moderate, only a small amount of energy is expended to place a single bill into the stack. The backer plate 27 and guides 77*a*,77*b*,73*a*,73*b* provide a bill receiver in which bills are accumulated in a stack by successive bill accumulation operations effected by movement of the stacker bars 18*a* and 18*b*. As seen in FIGS. 2*a*–*d*, a surface of the stacker bar bears against the most recently accumulated bill in the stack and thus maintains the accumulated stack in the receiver.

The back up plate 27 may be molded from rigid injection moldable plastic and the graspers may be integrally molded as part of the back up plate. Of course if spring metal feet were desired these could be riveted to the plate or affixed by other standard methods. In another embodiment, guides 77*a*, 77*b*, 73*a*, and 73*b* could be eliminated and instead of the graspers, drag springs would simply apply drag force to the inside walls of the stacker box.

According to elementary mechanics the amount of work need to place N bills in to the stack will be $W=N\times F\times T$ Where F is the total drag friction of the feet and T is the average incremental thickness (about 0.0045 inches) required to store a stacked bill. Since the bills are so thin very little work is expended to stack them.

A small motor is used for rotating the stacker bars, and enough energy can be supplied by small batteries to stack many bills. Bill conveyance and stacking are low energy operations by virtue of the conveyance and stacking mechanisms described in this present invention and only occur intermittently, thus solar cells may be used to trickle charge small rechargeable batteries to power the entire stacker/validator system. The present invention is therefore admirably suited for use in areas where power is scarce or virtually unavailable. Such applications would include outdoor pay phones and news paper vending machines among many others.

The simple mechanics of the novel stacker just described allows it to be incorporated into a bill validator as a removable portable cassette stacker.

Turning once again to FIG. 1 a housing including a container 34 with a hinged lid 30 which may be opened to allow access to the stacked bills is shown. The housing includes openings in the container and lid which provide means for receiving a security seal when the housing is closed. Such a security seal may be provided to restrict access so accumulated bills (e.g. a lock), to provide evidence when the housing has been opened and accumulated bills made accessible, or both. After a stacker cassette is emptied at an official receiving/counting station, the lid is closed and a seal 32, or a lock may be attached to it for security purposes. Seal 32 may be a heat sealable plastic seal or tape which if opened unofficially would show evidence of having been tampered with. In addition to the use of a special low cost sealable material the security of the seal may be further enhanced by placing a bar code 33 on it. Each bar code may be unique and registered in a data base when it leaves the official counting station. Thus each full cassette stacker must be returned in due time or it will be known to be missing with its contents. This then constitutes a secure currency handling system with a method of discouraging theft of currency.

Figure 5:
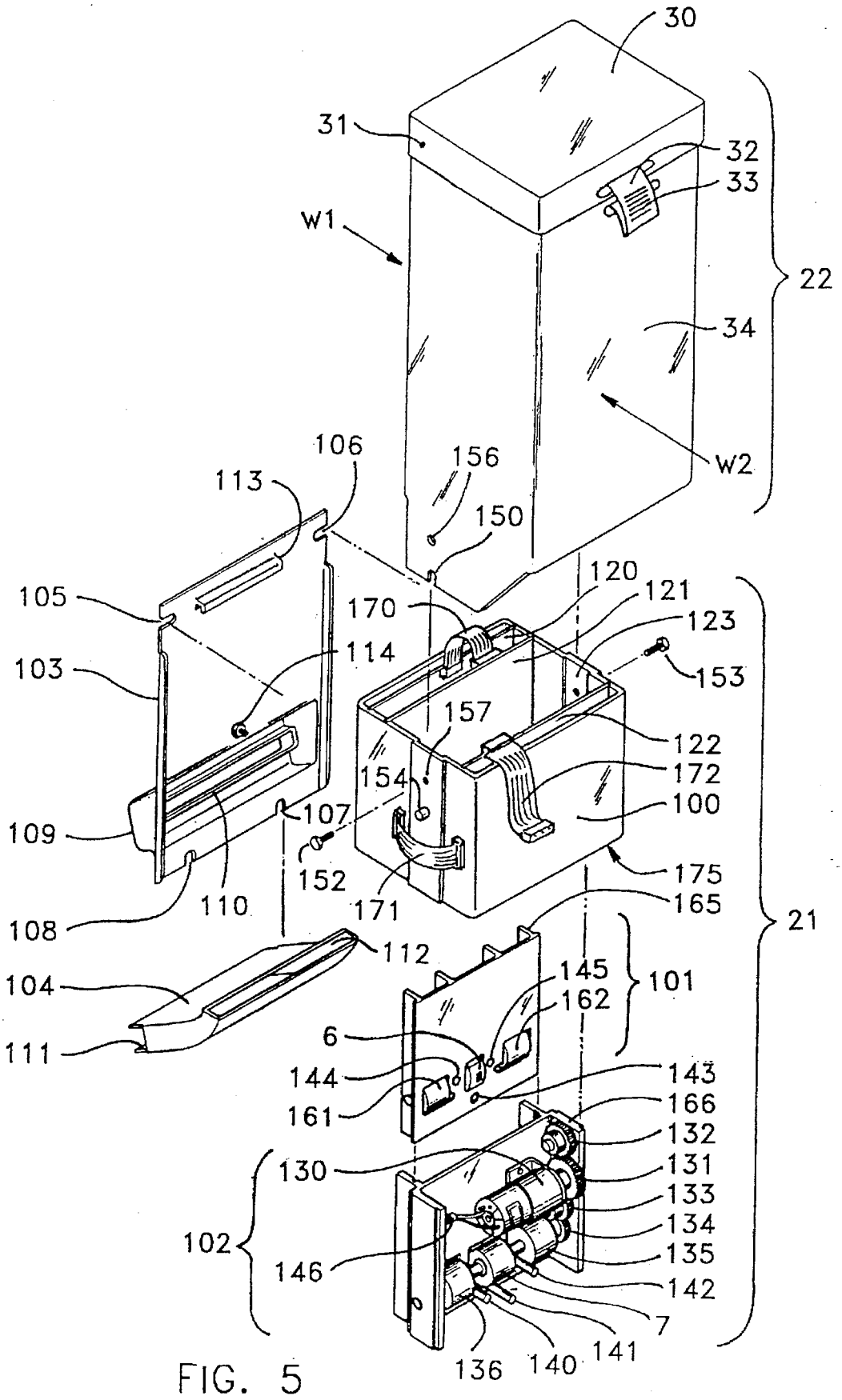
FIG. 5 shows a modular bill validator with a removable cassette stacker.

In addition to the portable, removable, and sealable features of the cassette stacker 22 it may be seen from observation of FIG. 5 that validator drive module 21 may be fitted with cassette stacker modules of different capacities by simply extending the width W1–W2 of the cassette stacker at the end labeled W2. This is possible because only the front end components of the cassette consisting of the stacker belts, their pulleys and bars are critical to the interface and function of the stacker. Because of its simplicity and few parts the entire sealable cassette stacker module may be molded from light-weight plastic and is easy to remove and transport.

HORIZONTAL AND DOWN STACKER EMBODIMENTS

The entire assembly of FIG. 5 is depicted as an "upstacker" configuration which is very popular for soft drink vending machines. Horizontal stacker configurations are also popular and these are also readily possible to configure with the key elements of the present invention.

The upstacker version of the present invention may be converted to horizontal stacker embodiment by eliminating the curved infeed guide 104 as shown in FIG. 5 and attaching a bezel to validator housing 100 at the end indicated by arrow 175. This configuration allows for an essentially straight bill path from the feed input of the bezel through the stacker.

A down stacker version is easily configured by simply mounting the up stacker version upside down and mounting the front bezel appropriately.

VALIDATOR MODULE OPERATION

In accord with goals of the present invention the bill validator may be separated into two separate modules as shown in FIG. 5. Portion 22 constitutes the stacker module while portion 21 constitutes the validation module which is capable of stand alone operation wherein accepted bills may simply be allowed to fall into a bin.

The validation/drive module 21 contains the most expensive parts including most of the electronics and at least one motor. While the cassette stacker may be built mostly from low cost plastic parts and may only contain a few inexpensive electronic parts, such as a small stacker bar drive motor and sensors.

Returning now to FIG. 5, the entire validation module 21 is completely separable from the cassette stacker 22. The validation module 21 contains the recognition electronics, validation sensors, control electronics, power supply, and motor, whereas the stacker module 22 is essentially a low cost cassette.

The validation module 21 is intended to function entirely as a currency validator without a stacker. Some applications utilize validators without stackers and the accepted money simply falls into a bin where there is no concern for compact stacking. This feature increases the versatility of the present invention.

The validator module itself consists of its own sub modules several of which slide out making it easy to clean and service. The primary sub modules of the validator illustrated in FIG. 5 are the housing assembly 100, the sensor head assembly 101, drive module 102, the circuit card assemblies 120,121, and 122, the front bezel 103 and infeed guide 104. The cassette stacker 22 is also illustrated to show how it fits to the basic validator module 21 if desired.

In the embodiment shown in FIG. 5, the validation housing 100 is preferably made from extruded aluminum which acts as an electrostatic shield for its electronic components and has internal slotted features such as feature 132 which serve as locating guides. The slotted features act as guides for sliding in circuit cards 120, 121, and 122 as well as the drive module 102 which is also an extruded part. The sensor module 101 is built on an extruded chassis 165 which can slide into slots provided in the extruded drive module chassis 166. However in another embodiment the sensor module could have a sensor circuit affixed to it.

A bezel 103 attaches to the housing 100 by means of screw 114 and the front portion 111 of the infeed guide 104 attaches to the inner lip 110 of bezel 103. The infeed guide 104 gently aligns and guides a bill submitted from the front portion 109 of bezel 103 up through channel 112 so it may be aggressively grabbed and conveyed by power driven rubber rollers 136 and 135. Rollers 161 and 162 are independently suspended idler rollers preferably made from rubber and they apply light contact pressure to opposing driven rollers 136 and 135 respectively thereby providing positive grab and conveyance for a bill submitted to the device.

Between and mounted to the same shaft as drive rollers 136 and 135 is located a non-driven idle roller 7 which is preferably made of moderately compressible rubber. Idle roller 7 is located directly under magnetic sensor head 6 and serves to bring a bill into intimate contact with the magnetic gap of sensor head 6. In order to assure that sensor head 6 is in proper contact with roller 7, sensor head 6 is preferably flexibly mounted so it is spring loaded against roller 7. Flexibly mounting magnetic sensor head 6 also helps to isolate it from mechanical vibration generated by the gears of the drive train which can result in unwanted microphonic noise output from the magnetic head 6.

When a candidate bill is inserted into the infeed guide 104 its leading edge will encounter an optical sensor installed behind opening 143 which will activate drive motor 130 and its associated drive train consisting of gears 134,133,131, and 132.

As shown in FIG. 1 the optical sensor is preferably a beam interrupt sensor consisting of an LED 2 (light emitting diode) and a photo transistor receiver 3. The LED 2 is preferably vertically mounted on bottom circuit board 122 and projects its beam up through a transparent cylindrical light guide 141. The light emanating from the top of light guide 142 continues through an aperture 143 (as seen in FIG. 5) in sensor chassis 165 and is detected by a photo sensor such as a photo transistor 3 mounted directly on circuit card 121. When the beam is interrupted by a bill it is sensed by the photo transistor. Also since a low level of light can actually pass through the bill, fluctuations in the transmitted light due to paper density and printing on it may be detected by the photo transistor, amplified and electronically differentiated to yield valuable information about the validity and denomination of the submitted bill to prevent fraud. Similar sensors may be added for additional validation and sensing at positions indicated by non-centered light guides associated with apertures 144 and 145 as seen in FIG. 5.

Of course the optical sensors need not be of the transitive type described above. They may be reflective object sensing types with an integral LED and photo detector in the same package and may be mounted conveniently on bottom circuit card 122 or above on circuit card 121. Light guides such as light guide 141 can still be used to transmit light and receive reflected modulated light pulses from the candidate bill. The light guides may be tightly fitted to either chassis 166 or 165 to prevent liquid contamination from penetrating these chassis and clogging up the optical sensing means. They also provide a readily cleanable surface when such maintenance is needed.

The drive gear train associated with drive module 102 is powered by a reversible gear head drive motor 130 capable of conveying a bill at a rate of about 3 to 10 inches per second while supplying sufficient torque to do so. (It is necessary that drive motor 130 be reversible in the event that the bill is rejected and must be returned.) Its power is best provided through a cable 172 which conveniently plugs into circuit card 22. The gear motor 130 rotates main drive gear 131, idler gear 133 and feed roller drive gear 134 which drives rollers 35 and 136 used to pull a bill into the device.

Main drive gear 131 also powers transfer gear 132 (FIG. 5) which supplies power to the lower stacker drive pulleys 10*a* and 10*b* (FIG. 2*a*) when the stacker module is attached to the validator module.

Once a bill is fed into the device and is conveyed by rollers 36 and 135, the bill preferably follows an essentially straight path, is then engaged by the stacker belts 9 and 19 and carried to the end of the stacker.

An essentially straight bill path from the primary rollers 35 and 136 to the top of the stacker provides a highly reliable jam free path for a bill to follow.

Although a right angle bend may be designed into the bill path using key concepts of the present invention and still retain many advantages, the straight bill path is the preferred embodiment for reliability reasons.

Slide in circuit card 121 is best used for processing sensitive low level analog signals from magnetic sensor 6 and the optical sensors. Lower circuit card 122 is best used for less sensitive circuitry such as power supply circuits, motor control circuits, LED drive circuits, and output cables. Circuit card 120, if needed, may be used for digital and micro-processor circuits. The circuit cards may be wired together with readily accessible side pluggable cables 170 and 171 where side slots are provided for plugs on cable 171 and an input/output cable 172. The plugs also serve to lock the boards in place to prevent them from sliding.

A stacker bar drive motor located in the bottom or top of stacker cassette housing 34 is elegantly interfaced to one of the circuit cards 120 or 121 with a Teledyne Surface Stack connector to enable easy removal of stacker cassette module 22 without the necessity of plugs and sockets. Such an interface enables the validation module to provide electrical power and control signals to the stacker cassette module while permitting it to be easily detachably securable to the validation module. If desired, sensors may also be incorporated into the stacker and interconnected by means of the Teledyne connector. A reflective object sensor 16 is used to positively confirm that a bill has reached the top of the stacker and has been stacked.

CLEANING AND SERVICING

The magnetic head sensors and optical components of validators occasionally need to be cleaned because wet, greasy or dirty currency can foul these parts. Non-modular single unit currency validators have proven to be difficult and expensive to service because of their many interconnected and interlocked parts.

The present invention, however, with its novel stacker, simple drive system and modular architecture allows for easy module servicing in any of its multiple configurations. In fact it is readily field serviceable by simply swapping modules.

MAGNETIC SENSING

Certain areas of U.S. currency are printed with magnetic ink. In order to detect the presence of magnetic ink some prior art currency validators magnetize this magnetic ink by passing it over a permanent magnet whereupon it is magnetized. As the magnetized ink areas subsequently pass over a magnetic read head with a low level electric current passing through its winding, a signal from the head is obtained then amplified. The amplified signal contains information responsive to the magnetic printing on the currency which is used to validate it.

This prior art system is highly sensitive to mechanical vibrations within the equipment which appears as microphonic noise. Also, current passing through the head causes thermal noise or Johnson noise to be produced which also appears at the output of the head. These two noise effects degrade the signal to noise ratio of the head output. Furthermore the heads for these systems are designed to accommodate current and must be specially encapsulated to ameliorate mechanical vibration effects.

Other magnetic ink read systems use expensive magnetoresistive heads but these are not capable of ultra fine print resolution.

An improved method for reading magnetic printing on paper currency is now disclosed which is substantially free of the above mentioned noise effects and which utilizes common heads found in low cost consumer type sound playback equipment.

Magnetizeable materials consist of small domains which in themselves are always permanently magnetized. When the domains are substantially aligned the material is said to be magnetized and exhibits and overall magnetic polarity.

In the magnetic sensing method of the present invention not necessary to magnetize the ink as long as the head gap is properly sized to respond to domains in the ink. Nor is it necessary to pass DC current through the head winding—indeed this would be undesirable because of the accompanying thermal noise which would be produced.

Figure 6:
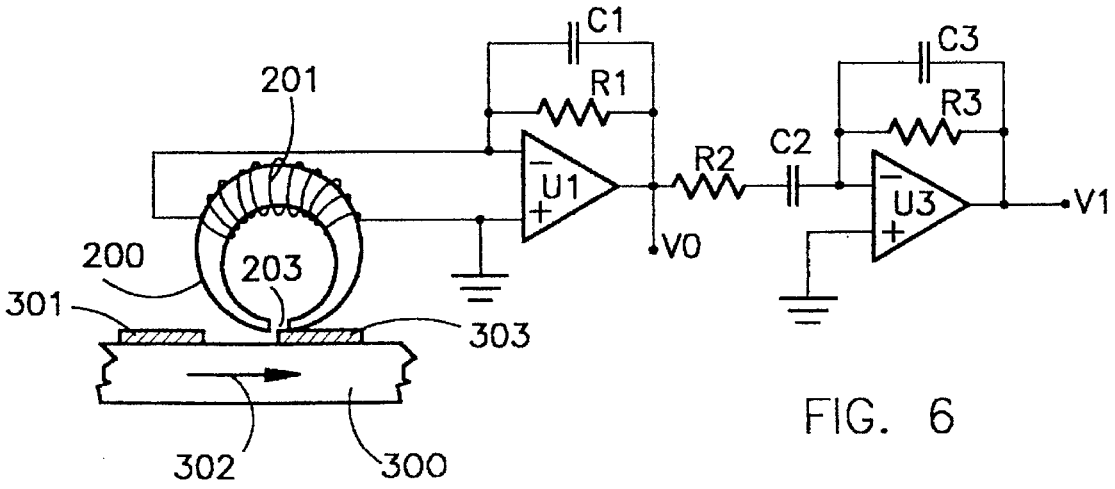
FIG. 6 shows a magnetic sensor circuit.

Referring to FIG. 6, a magnetic head consisting of ferromagnetic core 200 with a winding 201 around it has a gap 203. The gap 203 is sized so that its length is responsive to magnetized areas which are on the order of the magnetic domains in the ink itself.

The magnetic domains at the edges of the printed ink pass the gap they excite the head winding 201 thereby producing current (I) in it. This current is then fed directly to the negative input of an FET input OP-AMP, U1, configured as a current to voltage conversion amplifier wherein the voltage output Vo of the amplifier is I/R1 and is representative of the magnetic ink patterns printed on the currency. It is best to use an FET input type OP-AMP for U1 in order to minimize current flow into the negative input. This minimizes Johnson noise. (Bi-Polar transistor input OP AMPS consume some small base input current which causes noise.) It is desirable to minimize winding resistance in Coil 201 to further reduce Johnson noise and to select R1 for largest signal to noise ratio at Vo. Naturally the gain bandwidth of the amplifier selected must also be taken into account according to good practice.

Figure 8:
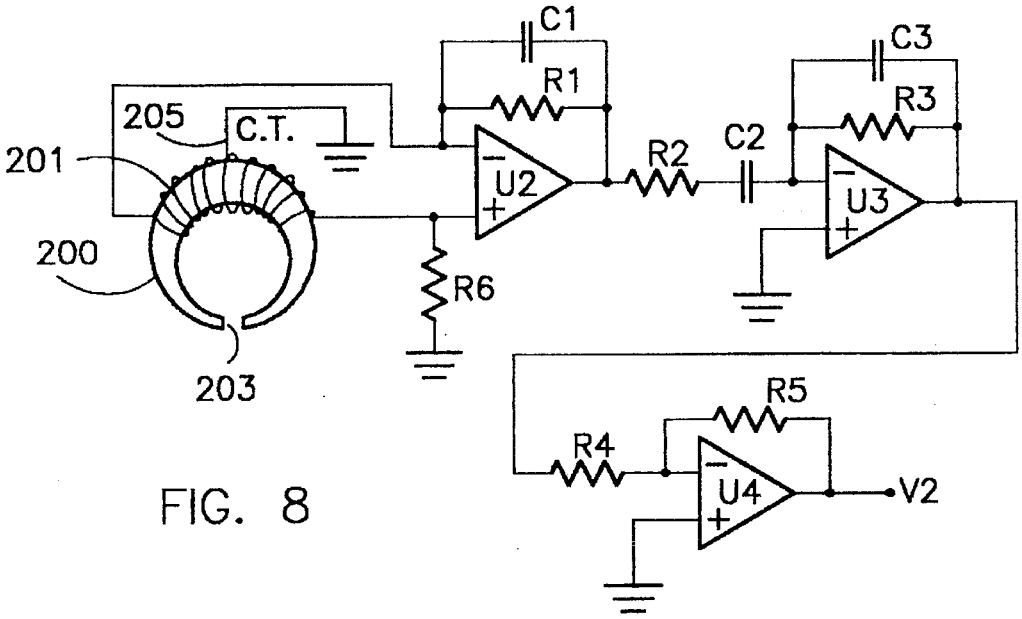
FIG. 8 shows an alternate magnetic sensor circuit.
Figure 9:
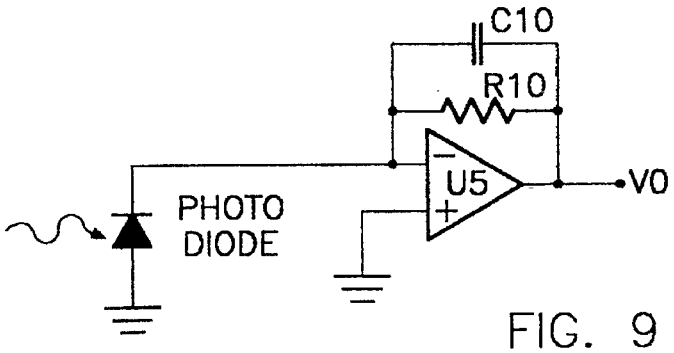
FIG. 9 shows an optical sensor circuit.

For even lower noise, especially for immunity from stray induced signals such as hum, the first stage of amplification preferred is a balanced differential input current to voltage conversion amplifier such as depicted in FIG. 8.

In order to digitize the amplified head signal, Vo is differentiated in a well known differentiator circuit consisting of U3, R2,C2,R3,C3.

The derivative signal V1 is primarily responsive to transitions between magnetic ink areas and non-ink areas and not lower level noise.

Derivative signal V1 is then fed into a comparator circuit, consisting of U4, R4 and R5 which has a hysteresis band determined by the ratio of R4/R5 selected to preclude transitions due to signal jitter or noise. The final output signal V2 is then obtained which consists of clean reliable computer processable square wave pulses.

The whole of this circuit and head combination represents a great simplification over prior art circuits and it has been found that inexpensive mass production heads commonly used in consumer grade cassette stereo, high fidelity equipment and portable tape players are admirably suited to this application.

OPTO-SIGNAL PROCESSING

The light signal processing techniques used for a best mode implementation of the present invention are considered to be transmissive ones wherein light from LEDs are beamed through the currency. Transmitted light fluctuations due to paper density and printing are received by photo transistors or photo diodes. The transmitted signals are amplified, filtered and digitized as are the magnetic signals. The optical analog signals may be processed to determine the transmissive properties of the paper itself. U.S. currency paper is very stringently controlled with regard to its density and composition. Therefore an opacity measurement of the paper constitutes a material test of the paper and is a very good indicator of authenticity. In addition the analog optical signals may be analyzed to ascertain light modulation due to opacity of printing on both sides the bill as well as magnetic printing in different areas simultaneously.

Figure 10:
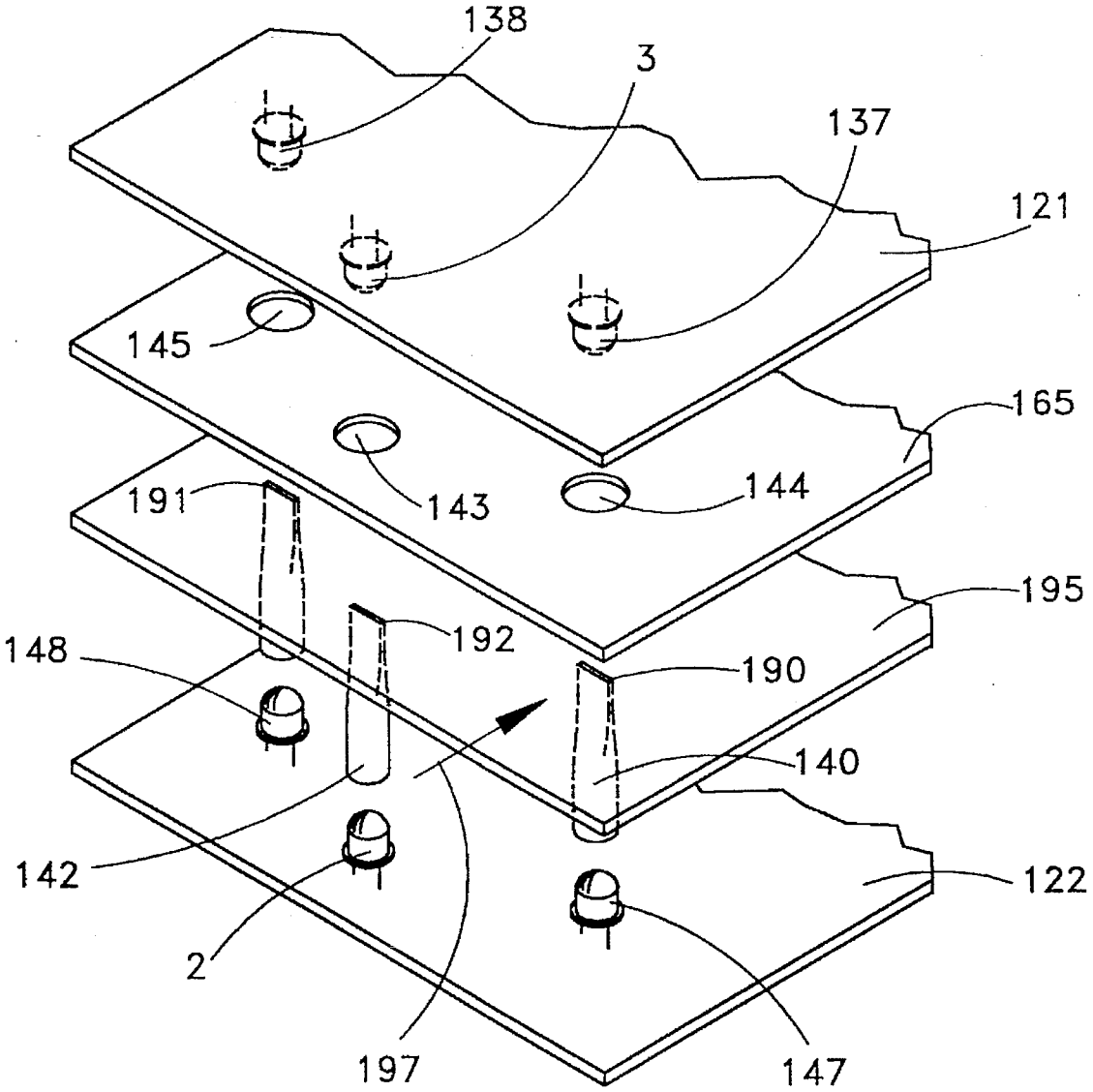
FIG. 10 shows an arrangement of light guide, LEDs, and photoelectric converters.

Turning now to FIG. 10 greater detail of the light guide of the current invention is revealed. A light guide 142 is preferably molded from plastic with a high index of refraction. Polycarbonate plastic with an index of refraction of 1.58 is an excellent choice. Light from LED 2 is directed into the wide end of light guide 142. Light then travels to the narrow top end 192 of the guide and is guided thereto by means of the phenomenon of total internal light reflection. The top of guide 142 is best shaped like a narrow rectangle 192. As a bill passes over the top of the narrow portion of the guide on surface 195 in the direction of arrow 197 a very great resolution for discriminating printing on a bill is afforded. The arrangement of FIG. 10 is a transmissive one and light penetrating the bill reaches photodetector 3 through aperture 143. The width of the top of the light guide is typically about 6 millimeters and side to side variations in printing on bills are thereby averaged out.

For extremely high security levels (not mistakenly identifying the denomination of a bill or its authenticity) the present validation system can make combinations of simultaneous measurements on currency. These measurements may include: paper density, magnetic print patterns, and print pattern modulation analyses obtained from different areas (middle and sides) of bills for the front and back simultaneously. For example on U.S. paper currency the federal reserve bank seal is printed with black non-magnetic ink whereas other black ink on the portrait side of the bill is printed with magnetic ink. In addition the printed value of the bill on the portrait side which is spelled out in large letters is printed with magnetic ink on top of a colored seal printed with non-magnetic ink. By reading these patterns of ink and determining both their magnetic and optical properties especially where one type ink is printed over another, a high level of security and protection against fraud is afforded. It is noted that the sensors of the present invention can be used to perform multiple kinds of measurements on the inks and paper (material) of currency.

In order to facilitate analysis of print patterns on bills it is very useful to check the patterns at distinct selected intervals along the length of the bill as it passes through the validation sensors.

This is done by noting when the bill is first detected by one of the validation sensors such as magnetic head 6 in FIGS. 1 or 5 at the moment the bill is engaged by the conveyance rollers such as rollers 136 and 135 in FIG. 5. Progress of the bill through the sensor system may then be measured by timing signals generated by counting the passing of teeth in one of the gears 134,133,131, or 132 either optically or magnetically. FIG. 1 shows a reflective object sensor 39 for the purpose of detecting the teeth in gear 41. These signals are then correlated to expected patterns along the length of the bill for authenticity and value determinations. The timing signals may also be generated by using a hall effect magnetic sensor in conjunction with a ferromagnetic gear. The simplest method however is to mount a photo reflective object sensor on lower circuit card 122 and aim it at the teeth of a white plastic gear in the drive train above it.

While particular embodiments of the present invention have been illustrated and described herein, it is not intended to limit the invention and changes and modifications may be made therein and still remain within the spirit of the following claims.

What is claimed is:

1. A method for magnetically sensing printed magnetic ink patterns on a bill with a magnetic head sensor, comprising the steps of:

(A) providing a ferromagnetic core which is unmagnetized in the absence of an applied magnetic field;

(B) moving substantially non-magnetized magnetic ink patterns on said bill past a gap in said core and simultaneously receiving, with a coil wound on said core, only electrical signals generated by movement of said substantially non-magnetized magnetic ink patterns on said bill past said gap in said core;

wherein said gap is adapted to produce said electrical signals responsive to magnetic domains present at edges of said substantially non-magnetized magnetic ink patterns on said bill when said edges are moved past said gap in step (B) above.

* * * * *